US010695253B2

(12) United States Patent
Patel

(10) Patent No.: US 10,695,253 B2
(45) Date of Patent: Jun. 30, 2020

(54) VESTIBULAR OPTIMIZER DEVICES, SYSTEMS, AND METHODS

(71) Applicant: Milap N. Patel, Savannah, GA (US)

(72) Inventor: Milap N. Patel, Savannah, GA (US)

( * ) Notice: Subject to any disclaimer, the term of this patent is extended or adjusted under 35 U.S.C. 154(b) by 1040 days.

(21) Appl. No.: 15/140,895

(22) Filed: Apr. 28, 2016

(65) Prior Publication Data

US 2017/0312160 A1 Nov. 2, 2017

(51) Int. Cl.
*A61H 1/00* (2006.01)

(52) U.S. Cl.
CPC ..... *A61H 1/001* (2013.01); *A61H 2201/164* (2013.01); *A61H 2201/1607* (2013.01); *A61H 2201/1623* (2013.01); *A61H 2201/1635* (2013.01); *A61H 2201/1671* (2013.01)

(58) Field of Classification Search
CPC ..... A61H 1/001; A61H 1/003; A61H 2201/1607; A61H 2201/1623; A61H 2201/1635; A61H 2201/164; A61H 2201/1671; A61H 2001/0203; A61B 5/4863; A47C 1/00; A47C 1/04; A61G 15/00; A61G 15/007; A61G 5/00; A61G 13/00; A61G 13/009; A61G 13/12
USPC ..... 601/15
See application file for complete search history.

(56) References Cited

U.S. PATENT DOCUMENTS 2,558,143 A * 6/1951 Lauterbach ..... A61G 15/02 297/69
5,303,715 A 4/1994 Nashner et al.
6,656,137 B1 * 12/2003 Tyldsley ..... A61M 21/00 434/185
6,796,947 B2 9/2004 Watt et al.
6,800,062 B2 * 10/2004 Epley ..... A61B 5/11 600/558

(Continued)

FOREIGN PATENT DOCUMENTS

| | | |
|---|---|---|
| CN | 2178101 | 9/1994 |
| CN | 103784292 | 5/2014 |
| WO | WO2014102617 | 7/2014 |

OTHER PUBLICATIONS

"Vestibular Testing," Timothy C. Hain, MD, "American Hearing Research Foundation," published Sep. 2012, pp. 1-9, retrieved Jan. 12, 2016, http://american-hearing.org/disorders/vestibular-testing/.

(Continued)

*Primary Examiner* — Bradley H Philips
*Assistant Examiner* — Vincent D Hoang
(74) *Attorney, Agent, or Firm* — Buchanan Van Tuinen LLC

(57) ABSTRACT

The technical description relates to a vestibular optimizer device configured to administer vestibular stimulation to a subject having a head. An example vestibular optimizer device includes a chair having a base, a seat, a back, and a support member, the support member extending from the base to the seat, having a central longitudinal axis, and being attached to the seat, the support member rotatable about the central longitudinal axis, the seat adapted to move toward and away from the base, the chair adapted to move in a first pattern of movements. It also includes a head engaging member attached to the back of the chair and configured to engage the head of the subject, the head engaging member adapted to move in a second pattern of movements.

15 Claims, 5 Drawing Sheets

(56) References Cited

U.S. PATENT DOCUMENTS

| | | | | |
|---|---|---|---|---|
| 7,651,224 | B2 | 1/2010 | Wood et al. | |
| 7,856,275 | B1 | 12/2010 | Paul et al. | |
| 8,355,788 | B2 | 1/2013 | Mechlenburg et al. | |
| 8,702,631 | B2 | 4/2014 | Maher | |
| 9,167,998 | B2 | 10/2015 | Crane | |
| 9,198,571 | B2 | 12/2015 | Kiderman et al. | |
| 9,995,940 | B2 * | 6/2018 | Tseng | G02B 27/0176 |
| 2004/0097839 | A1 | 5/2004 | Epley | |
| 2004/0189079 | A1 * | 9/2004 | Naganuma | A61B 5/00 297/464 |
| 2006/0235331 | A1 | 10/2006 | Kiderman | |
| 2009/0326604 | A1 | 12/2009 | Tyler et al. | |
| 2010/0036289 | A1 | 2/2010 | White et al. | |
| 2013/0303939 | A1 | 11/2013 | Karmali et al. | |
| 2014/0046231 | A1 | 2/2014 | Barlow et al. | |
| 2014/0087340 | A1 * | 3/2014 | Maher | A61B 5/11 434/247 |
| 2015/0305509 | A1 | 10/2015 | Verdier et al. | |
| 2016/0007849 | A1 * | 1/2016 | Krueger | A61B 3/113 600/301 |
| 2016/0213551 | A1 * | 7/2016 | Budagher | A61H 5/00 |

OTHER PUBLICATIONS

"Rotary chair offers more concise diagnosis for TBI patients," Thomas Brennan, JDNews.com, published May 5, 2014, pp. 1-4, retrieved Jan. 12, 2016, http://www.jdnews.com/20140505/rotary-chair-offers-more-concise-diagnosis-for-tbi-patients/305059887?page=0.

"Chronic Subjective Dizziness," Jeffrey P. Staab, MD, MS, Continuum Lifelong Learning Neurol 2012; 18(5): 1118-1141.

"Diagnostic Criteria for Persistent Postural-Perceptual Dizziness (PPPD): Consensus document of the Committee for he Classification of Vestibular Disorders of the Barany Society," Jeffrey R Staab, MD, MS, et al., pp. 1-45.

"System 2000 Auto-Traverse Rotational Chair," Micromedical Technologies, pp. 1-2, retrieved Jan. 12, 2016, http://www.micromedical.com/Products/Rotational-Chairs/System-2000-Auto-Traverse-Rotational-Chair.

"System 2000 Comprehensive Rotational Chair," Micromedical Technologies, pp. 1-2, retrieved Jan. 12, 2016, http://www.micromedical.com/Products/Rotational-Chairs/System-2000-Comprehensive-Rotational-Chair.

"System 2000 Reclining Rotational Chair," Micromedical Technologies, pp. 1-2, retrieved Jan. 12, 2016, http://www.micromedical.com/Products/Rotational-Chairs/System-2000-Reclining-Rotational-Chair.

"System 2000 Auto Traverse Rotational Vestibular Chair," Micromedical Technologies, pp. 1-6, published Mar. 2014, retrieved Jan. 12, 2016.

"System 2000 Reclining Rotational Vestibular Chair," Micromedical Technologies, pp. 1-4, published Mar. 2014, retrieved Jan. 12, 2016.

* cited by examiner

VESTIBULAR OPTIMIZER DEVICES, SYSTEMS, AND METHODS

FIELD

The disclosure relates to the field of vestibular optimizer devices, systems, and methods. More particularly, the disclosure relates to vestibular optimizer devices, systems, and methods designed to reduce the effects of disruptions to normal functioning of the vestibular system.

BACKGROUND

The vestibular system acts as a mechanism to maintain balance of an individual by monitoring the motion of the head and stabilizing the eyes relative to the surrounding environment. The vestibular system includes various organs disposed within the inner ear that sense movement and acceleration of the head in various directions.

A healthy vestibular system supplies the brain stem reliable information regarding spatial orientation, including information regarding the spatial orientation of the head. Normal functioning of the vestibular system can be disrupted, however, leading to transmission of inaccurate or unreliable information to the brain stem. A number of factors can contribute to such disruption, including several age-related factors. For example, an acoustic neuroma may grow on the vestibule-cochlear nerve. Contact between inner ear organs and various other bodies, including loose debris and skin (cholesteatoma) and bone growths (otosclerosis) can also disrupt the vestibular system. Moreover, many diseases and conditions can have a negative impact on the functioning of the vestibular system, including Meniere's disease, migraine associated vertigo, and various autoimmune diseases.

No matter the cause, disruptions to normal functioning of the vestibular system frequently have lifestyle-changing impact on the individual. These disruptions typically lead to spatial disorientation, which is the sensation of not knowing where one's body is in relation to one or both of the horizontal and vertical planes. Affected individuals are often forced to limit their movement and can become physically ill while disoriented.

Disruptions to normal vestibular function are common. One study indicates that as many as thirty-five percent of United States adults aged 40 years or older have experienced at least some type of vestibular dysfunction. (Agrawal, Y., et al., "Disorders of balance and vestibular function in US adults," Arch. Intern. Med. 2009; 169 (10): 938-44.)

Not surprisingly, the art includes a number of approaches to treating disruptions to normal vestibular function. For example, several approaches for stimulating the vestibular system include moving a subject in a particular physical pattern, whether horizontally, vertically, or rotationally. These approaches typically refrain from moving the affected individual, opting instead to move an apparatus (such as a chair, stool, or platform) on which the subject rests. These approaches aim to move the head in concert with the body and avoid movement of the head and/or neck independently of the body. U.S. Pat. No. 8,702,631 to Maher for VESTIBULAR STIMULATION SYSTEMS AND METHODS describes an example that follows this treatment approach Despite this and other examples, a need exists for improved vestibular optimizer devices, systems, and methods.

BRIEF SUMMARY OF SELECTED EXAMPLES

Various example vestibular optimizer devices, systems, and methods are described and illustrated herein.

An example vestibular optimizer device configured to administer vestibular stimulation to a subject having a head comprises a chair having a base, a seat, a back, and a support member, the support member extending from the base to the seat, comprising a central longitudinal axis, and being attached to the seat, the support member rotatable about the central longitudinal axis, the seat adapted to move toward and away from the base, the chair adapted to move in a first pattern of movements, and a head engaging member attached to the back of the chair and configured to engage said head of said subject, the head engaging member adapted to move in a second pattern of movements.

An example system configured to administer vestibular stimulation to a subject having a head comprises a chair having a base, a seat, a back, and a support member, the support member extending from the base to the seat, comprising a central longitudinal axis, and being attached to the seat, the support member rotatable about the central longitudinal axis, the seat adapted to move toward and away from the base, the chair adapted to move in a first pattern of movements, a head engaging member attached to the back of the chair and configured to engage the head of said subject, the head engaging member adapted to move in a second pattern of movements, and a goggle apparatus configured to be worn on said head of said subject, the goggle apparatus comprising a frame, a lens attached to the frame, and a strap attached to the frame and configured to engage said head.

An example method of administering vestibular stimulation to a subject having a head, comprises the steps of placing the subject in a vestibular optimizer device comprising a chair having a base, a seat, a back, and a support member, the support member extending from the base to the seat, comprising a central longitudinal axis, and being attached to the seat, the support member rotatable about the central longitudinal axis, the seat adapted to move toward and away from the base, the chair adapted to move in a first pattern of movements, and a head engaging member attached to the back of the chair and configured to engage the head of said subject, the head engaging member adapted to move in a second pattern of movements, engaging said head of the subject with the head engaging member, moving the chair in the first pattern of movements, and moving the head engaging member in the second pattern of movements.

Additional understanding of claimed vestibular optimizer devices, systems, and methods can be obtained by reviewing the detailed description of selected examples, below, with reference to the appended drawings.

DETAILED DESCRIPTION OF SELECTED EXAMPLES

Figure 1:
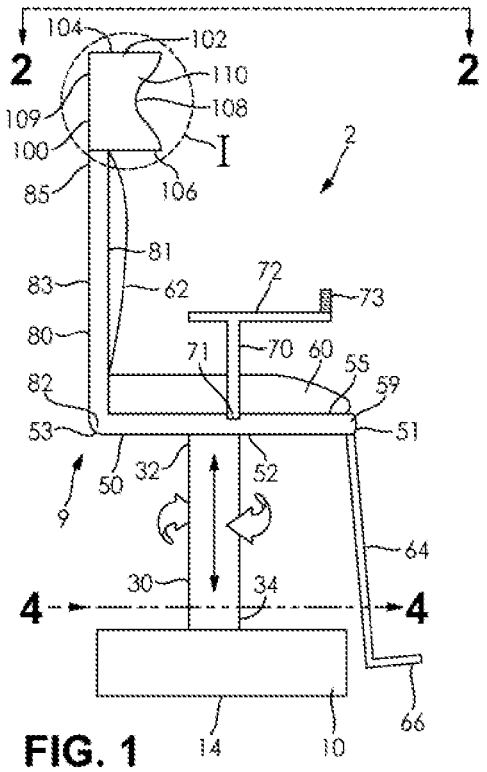
FIG. 1 is a side view of a first example vestibular optimizer device.
Figure 2:
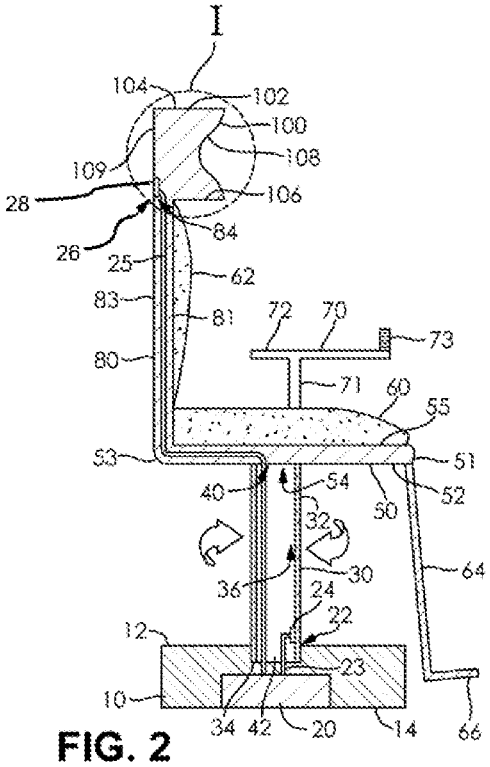
FIG. 2 is a cross-sectional view of the vestibular optimizer device illustrated in FIG. 1 taken along line 2-2.

The following detailed description and the appended drawings describe and illustrate various example vestibular optimizer devices, systems, and methods. The description and illustration of these examples are provided to enable one skilled in the art to make and use vestibular optimizer devices and systems, and to perform related methods. They are not intended to limit the scope of the claims in any manner.

As used herein, the term "central longitudinal axis" refers to the axis that extends vertically through the planes containing the proximal end, the distal end, and the geometric center of the support member, and the seat and the base.

Each of FIGS. 1, 2, 3, 4, 5, 6, 7A, and 7B illustrates an example vestibular optimizer device 2 or one or more components thereof. The vestibular optimizer device 2 comprises chair 9 having a base 10, a support member 30, a seat 50, a back 80, and a head engaging member 100.

The base 10 is substantially box-shaped and includes a proximal end 12 and a distal end 14. The base 10 also defines a cavity 16 that is in fluid communication with a cavity opening 18 that is disposed on the proximal end 12 of the base 10. The cavity 16 is configured to a house a motor, such as motor 20, described below, and/or various components thereof. Various cavities may be defined by any portion of the base in other embodiments. A skilled artisan will be able to determine how to suitably configure one or more cavities, if desired, according to a particular example based on various considerations, including the specifications of the motor and whether one or more motors is housed within a particular cavity. In other example embodiments, the base may define zero, one, two, three, or more than three cavities and one or more of these cavities may define a cavity opening. In other example embodiments, the base may be configured to house zero, one, two, three, or more than three motors.

The motor 20 disposed within the base 10 is configured to control the movements of the chair 9 and the head engaging member 100. These movements are described in greater detail below. The motor 20 is operably connected to each of a first control mechanism 22 and a second control mechanism 26. The first control mechanism 22 comprises a first wire 23 that is connected to the motor 20 and a first control unit 24. The first wire 23 extends through the cavity opening 18 defined by the base 10 and the support member opening (described below) of the support member 30 and connects the motor 20 to the first control unit 24, which is disposed on the inner wall (described below) of the support member 30. The first control unit 24 controls and effects the displacement of the support member 30 relative to the base 10. The first control unit 24 also contains a first set of software instructions (not illustrated in the Figures) that communicates particular movements of the support member 30 to the motor 20, which carries out these instructions. The first set of software instructions may provide various settings that correspond to particular movements of the support member that are effectuated through the motor.

The second control mechanism 26 comprises a second wire 25 that is connected to the motor 20 and a second control unit 28. The second wire 25 extends through the cavity opening 18 defined by the base 10, each of the support member openings (described below) defined by the support member 30, through a support member (described below) defined by the seat 50 and back 80 of the chair 9, and through a head engaging member opening (described below). The second wire 25 connects the motor 20 to the second control unit 28, which is disposed on the inner wall (described below) of the head engaging member 100. The second control unit 28 controls the rotational movement of the head engaging member 100 and movement of the head engaging member 100 towards and away from the base 10. The second control unit 28 also contains a second set of software instructions (not illustrated in the Figures) that communicates particular movement of the head engaging member 100 to the motor 20, which carries out these instructions. The second set of software instructions may provide various settings that correspond to particular movements of the head engaging member 100 that are effectuated through the motor.

The motor 20 is operably connected to a control pad (not illustrated in the Figures) that allows a user of the vestibular optimizer device 2 to control the movements of the head engaging member 100 and chair 9 by selecting various settings. The control pad controls the motor 20 wirelessly. A skilled artisan will be able to determine how to suitably configure the first and second control mechanisms, if desired, according to a particular example based on various considerations, including the specifications of the motor and the desired movements of the head engaging member and chair. In other example embodiments, the first control mechanism may be operably connected to a first motor and the second control mechanism may be operably connected to a second motor. In such an embodiment, the second motor may be disposed on or within any portion of the vestibular optimizer device, including within the head engaging member. In other example embodiments, the motor may be disposed within any portion of the chair, including within the support member, back, seat, and head engaging member. In other example embodiments, one or more of the motor, the chair, and the head engaging member may include a physically-attached control pad that allows a user to select particular movements of the head engaging member and chair.

In the illustrated embodiment, the support member 30 comprises an elongate and tubular shaft having a proximal end 32, a distal end 34, and a support member passageway 36 having a support member wall 38 extending from the proximal end 32 to the distal end 34. The support member 30 is substantially cylindrical and extends from the base 10 to the seat 50. The proximal end 32 of the support member defines a proximal opening 40 and the distal end 34 of the support member defines a distal opening 42; the proximal opening 40 is in fluid communication with the distal opening 42. The proximal opening 40 is in fluid communication with a support member (described below) defined by the seat 50 and back 80 and the distal opening 42 is in fluid communication with the cavity opening 18, and, therefore, the cavity 16, of the base 10. The support member 30 is configured to house the first wire 23, the second wire 25, and the first control unit 24. The support member may have any shape, size, and configuration, however. A skilled artisan will be able to determine a suitable shape, size, and configuration for the support member according to a particular example based on various considerations, including the shapes, sizes, and configurations of the seat and the base. In other example embodiments, the support member may have any shape, including conical, pyramidal, and box. The support member may also be integrally formed with one or both of the base and seat on other example embodiments.

As described above, the support member 30 is configured such that it can be moved toward or away from the base 10. More specifically, the proximal end 32 of the support member 30 can be moved both towards and away from the base 10 of the support member 30 via the motor 20 and the first control unit 24. The seat 50, due to its attachment to the support member 30, is therefore moved toward and/or away from the base 10 in concert with the support member 30. In this embodiment, a portion of the support member 30 may extend into the base 10 in order to move the support member 30, and the proximal end 32, in particular, amongst various positions relative to the base 10. Accordingly, the distal end 34 of the support member 10 is disposed within the base 10 and extends through its cavity opening 18. A skilled artisan will be able to determine how to suitably configure the support member according to a particular example based on various considerations, including the specifications of the first control unit and the desired displacement of the support member relative to the base. In various example embodiments, the proximal end of the support member may be displaced any distance from the proximal end of the base. Examples of suitable distances between the proximal end of the support member and the proximal end of the base include distances between about 1 inches and about 48 inches, distances between about 18 inches and about 36 inches, and distances between about 24 inches and about 32 inches.

Figure 4:
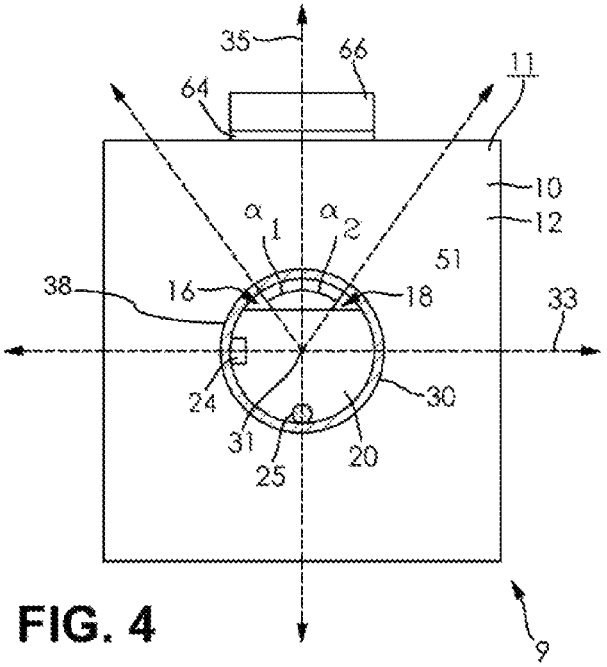
FIG. 4 is a top view of the section of the vestibular optimizer device illustrated in FIG. 1 taken along line 4-4.

The support member 30 is also configured to be rotatable based on instructions from the motor 20, the first control unit 22, and the control pad. As illustrated in FIG. 4, the central longitudinal axis 31 may be disposed on a plane 33 that is orthogonal to a plane 35 that extends through the leg rest (described below) of the chair 9 and geometric center of the support member 30. Each of the planes 33, 35 is parallel to the plane (not illustrated in the Figures) that contains the upper surface 11 defined by the proximal end 12 of the base 10. The support member 30 can rotate up to a first angle $\alpha_1$ relative to the proximal end 12 of the base 10; it can also rotate up to a second angle $\alpha_2$ relative to the proximal end 12 of the base 10. The first angle $\alpha 1$ may be substantially opposite to the second angle $\alpha_2$ relative to the plane 35. However, in other example embodiments, the support member may be rotated to any degree. A skilled artisan will be able to determine how to suitably configure the rotational ability of the support member according to a particular example based on various considerations, including the specifications of the first control unit and the desired displacement of the support member relative to the base. In various example embodiments, the support member may rotate up to any angle in either direction relative to the proximal end of the base. Examples of suitable first angles include angles between about 0° and about 50°, angles between about 10° and about 40°, and angles between about 20° and about 30°. Examples of suitable second angles include angles between about 0° and about −50°, angles between about −10° and about −40°, and angles between about −20° and about −30°. In other example embodiments, the support member may be rotated 360° about its central longitudinal axis.

The chair 9 also includes a seat 50 and a back 80. The seat 50 and back 80 are integrally formed and, cooperatively, are substantially L-shaped. The seat 50 includes a first end 51, a second end 53, a proximal end 55, and a distal end 52 that forms a seat opening 54 that is in fluid communication with the proximal opening 40 and a passageway (not illustrated in the Figures) that contains the second wire 25 and extends through the seat 50 and the back 80. The proximal end 55 is substantially opposite the distal end 52 and includes a first cushion 60 that is attached to the proximal end 55. The first cushion 60 may be attached to the proximal end 55 via one or more adhesives, as is shown in the illustrated embodiment. The first cushion 60 is configured to provide comfort to a subject that is seated on the first cushion 60. A skilled artisan will be able to determine how to suitably configure the seat according to a particular example based on various considerations, including the size and shape of the passageway and the desired comfort level of a subject. In other example embodiments, the chair may not contain a first cushion. In other example embodiments, the cushion may be attached to the seat via one or more mechanical attachment mechanisms. In other example embodiments, the seat may be formed separately from the back, rather than integrally formed with the back.

Attached to the first end 51 of the seat 50 is a leg rest 64. The leg rest 64 provides an area for a subject using the chair 9 to place his or her legs. The leg rest 64 is integrally formed with a footrest 66. The footrest 66 provides an area for a subject using the chair 9 to place his or her feet. The leg rest 64 may be attached to the seat 50 via a mechanical attachment. A skilled artisan will be able to suitably configure the leg rest and the footrest, if desired, according to a particular example based on various considerations, including the distance between the base and the seat and height of the base. In other example embodiments, the chair may not include a leg rest or a footrest. In other example embodiments, the chair may include only a leg rest. In other example embodiments, the leg rest and the footrest may not be integrally formed; instead, the footrest may be attached to the leg rest via one or more adhesives and/or mechanical attachments. In other example embodiments, one or both of the leg rest and footrest may be extendable.

Also attached to the seat 50 are first and second arm rests 70, 74. The first and second arm rests 70, 74 are substantially similar in shape and size and are each attached to a perimeter 59 of the seat 50. The first armrest 70 includes a mounted portion 71, which is attached to the seat via a mechanical attachment (not illustrated in the Figures), an arm bar 72, and a grip 73. As illustrated in FIG. 1, the grip 73 is threaded to allow for a subject to more easily hold the grip 73. The mounted portion 71 and arm bar 72 are substantially T-shaped. The second armrest 74 includes a mounted portion 75, which is attached to the seat via a mechanical attachment (not illustrated in the Figures), an arm bar 76, and a grip 77. The grip 77 is threaded to allow for a subject to more easily hold the grip 77. The mounted portion 75 and arm bar 76 are substantially T-shaped. A skilled artisan will be able to suitably configure the first and second arm rests, if desired, according to a particular example based on various considerations, including the shapes and sizes of the seat and the back. In other example embodiments, the first and second armrests may be integrally formed with the seat and/or back. In other example embodiments, the first and second armrests may be attached to the seat and/or back via one or more adhesives. In other example embodiments, the chair may include zero or one armrest. In other example embodiments, one or more of the armrests may be extendable.

The back 80 includes a first end 81, a second end 83, a distal end 82, and a proximal end 85 that forms a back opening 84 that is in fluid communication with the head engaging member opening (described below) and a passageway (not illustrated in the Figures) that contains the second wire 25 and extends through the seat 50 and the back 80. The first end 81 is substantially opposite the second end 83 and includes a second cushion 62 that is attached to the first end 81. The second cushion 62 may be attached to the first end 81 via one or more adhesives, as is shown in the illustrated embodiment. The second cushion 62 is configured to provide comfort to a subject whose back will rest on the second cushion 62. A skilled artisan will be able to determine how to suitably configure the back according to a particular example based on various considerations, including the size and shape of the seat and the desired comfort level of a subject. In other example embodiments, the chair may not contain a second cushion. In other example embodiments, the cushion may be attached to the back via one or more mechanical attachment mechanisms.

The head engaging member 100 includes a main body 102, a proximal end 104, and a distal end 106, a first end 108, and a second end 109. The main body 102 is comprised of a first side panel 110, a second side panel 120, and a base 130 disposed between the first side panel 110 and the second side panel 120. The head engaging member 100 also includes an adjustable headband 150. The head engaging member 100 is attached to the back 80 of the chair 9.

Figure 3:
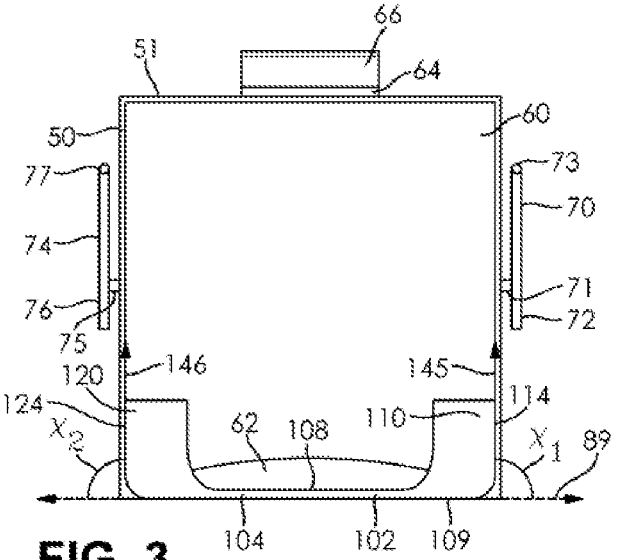
FIG. 3 is a top view of the vestibular optimizer device illustrated in FIG. 1.
Figure 5:
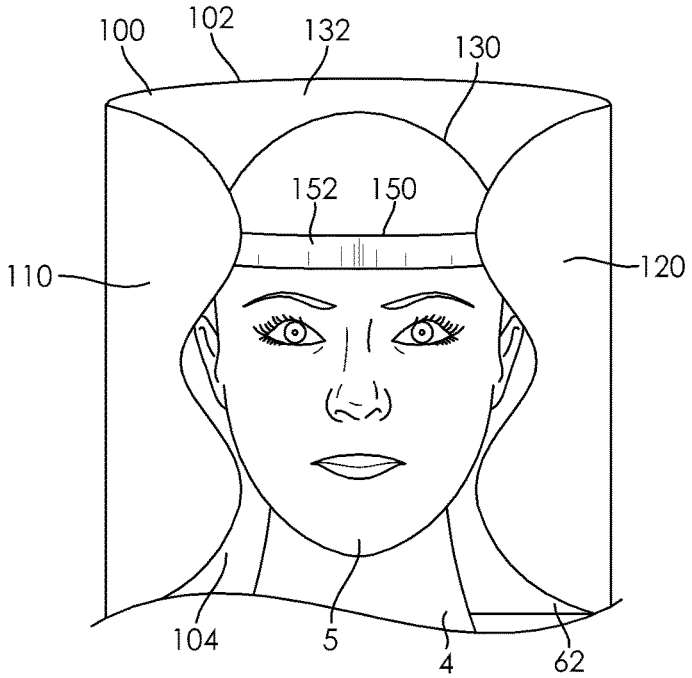
FIG. 5 is a magnified perspective view of Area I of the vestibular optimizer device illustrated in FIG. 1 and shows the head of a subject engaged by the head engaging member.

As illustrated in FIG. 3, the proximal end 104 of the main body 102 is substantially U-shaped. As FIG. 5 shows, the first side panel 110 is configured to contact the right side of a subject's 4 head 5, while the second side panel 120 is configured to contact the left side of a subject's 4 head 5. The first and second side panels 110, 120 are configured to engage the head 5 of the subject 4 and keep the head 5 from moving independent from the movement of the head engaging member 100, as instructed by the second control mechanism 24, the motor 20, and the control pad. The first and second side panels 110, 120 and the base 130 are comprised of a material that will not damage or injure a subject's 4 head 5. The main body may have any shape in other embodiments, however. A skilled artisan will be able to determine a suitable shape for the main body according to a particular example based on various considerations, including the size and shape of the back and the firmness with which the head should be held in place. In other example embodiments, the head engaging member can have any shape, including semi-conical, semi-cylindrical, and V-shaped. In other example embodiments, the head engaging member may comprise a board that does not include first and second side panels.

The head engaging member 100 includes an adjustable headband 150 that is attached to an inner wall 132 of the base 130 and provides additional stability to the head 5 of a subject 4, as shown in FIG. 5. The adjustable headband 150 is configured to surround at least a portion of the head 5 of a subject 4 and maintain the head 5 within its proper position. The adjustable headband 150 includes a cord 152 and an adjustment mechanism (not illustrated in the Figures), which allows the cord 152 to be tightened about a head 5. The adjustable headband 150 is attached to the inner wall 132 via a mechanical attachment (not illustrated in the Figures). A skilled artisan will be able to determine how to configure the adjustable headband, if desired, according to a particular example based on various considerations, including the size and shape of the main body of the head engaging member. In other example embodiments, the adjustable headband may not be adjustable. In other example embodiments, the adjustable headband may be attached via one or more adhesives to any portion of any of the base, the first side panel, and/or the second side panel of the head engaging member.

As described above, the head engaging member 100 houses a second control mechanism 24 that provides instructions to the head engaging member 100 indicating direction and degree of movement. In the illustrated embodiment, the proximal end 104 of the main body 102 has at least two primary directions of movement: movement towards and away from the seat 50 and rotational movement.

Figure 6:
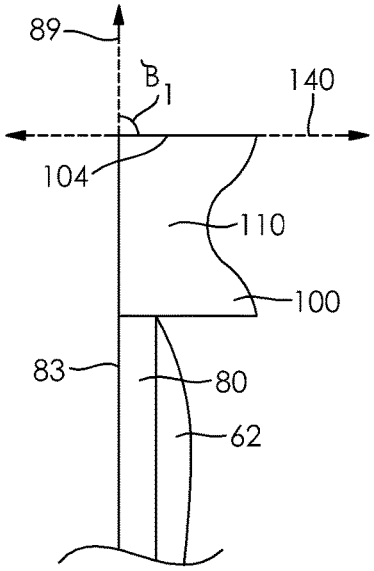
FIG. 6 is a side view of Area I of the vestibular optimizer device illustrated in FIG. 1. The head engaging member of the vestibular optimizer device is illustrated in a neutral position.
Figure 7A:
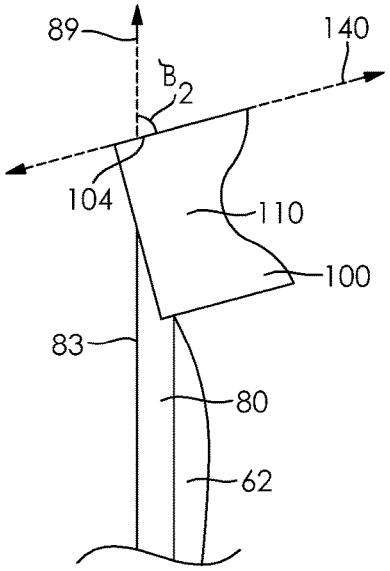
FIG. 7A is a side view of Area I of the vestibular optimizer device illustrated in FIG. 1. The head engaging member of the vestibular optimizer device is illustrated in an extended position.
Figure 7B:
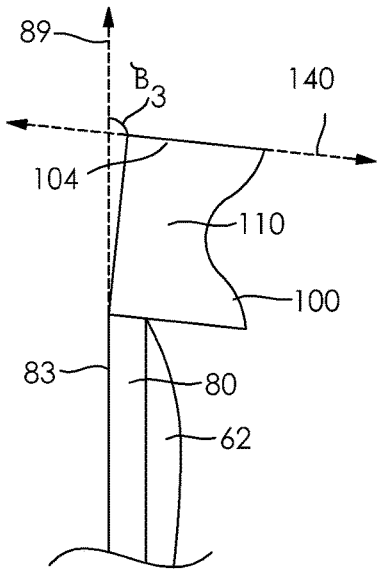
FIG. 7B is a side view of Area I of the vestibular optimizer device illustrated in FIG. 1. The head engaging member of the vestibular optimizer device is illustrated in a flexed position.

FIGS. 6 and 7 best illustrate movement of the head engaging member 100 towards and away from the seat 50. The proximal end 104 of the main body 102 of the head engaging member 100 is disposed on a first plane 140 that is substantially parallel to the plane (not illustrated in the Figures) on which the proximal end 12 of the base 10 is disposed. When the head engaging member 100 is in the neutral position, as illustrated in FIG. 6, the first plane 140 is set at a third angle 131 to the plane 89 on which the second end 83 of the back 80 is disposed. The plane 89 extends through the base 10 and is substantially parallel to a plane (not illustrated in the Figures) on which the first end 81 of the back 80 is disposed. In this embodiment, the first plane 140 is substantially orthogonal to the plane 89 when the head engaging member 100 is in the neutral position. However, when the head engaging member 100 is in the extended position, as illustrated in FIG. 7A, the first plane 140 is set at a fourth angle $\beta_2$ to the plane 89 on which the second end 83 of the back 80 is disposed. Additionally, when the head engaging member 100 is in the flexed position, as illustrated in FIG. 7B, the first plane 140 is set at a fifth angle $\beta_3$ to the plane 89 on which the second end 83 is disposed. Accordingly, in use, the head engaging member 100 may pivot both toward and away from the seat 50 and may pivot a head in each direction. In various example embodiments, the head engaging member may be angled to any degree. A skilled artisan will be able to determine how to suitably angle the first plane relative to the second plane according to a particular example based on various considerations, including the desired procedure of the vestibular optimizer device and the size and shape of the head engaging member. In various example embodiments, the head engaging member may have any angle relative to the back when it is in either of the neutral, extended, and flexed positions. Examples of suitable third angles include angles between about 80° and about 100°, angles between about 85° and about 95°, and angles between about 88° and about 92°. Examples of suitable fourth angles include angles between about 40° and about 90°, angles between about 50° and about 80°, and angles between about 60° and about 70°. Examples of suitable fifth angles include angles between about 90° and about 140°, angles between about 100° and about 130°, and angles between about 110° and about 120°.

As indicated above, the head engaging member 100 can also be rotated. The second end 109 is disposed on the same plane as the plane 89 on which the second end 83 of the back 80 is disposed. Additionally, the outer portion 114 of the first side panel 110 and the outer portion 124 of the second side panel 120 are disposed on third and fourth planes 145, 146, respectively, that form sixth and seventh angles $\chi_1$, $\chi_2$ to the plane 89 on which the second end 83 of the back 80 is disposed. In the illustrated embodiment, each of the sixth and seventh angles $\chi_1$, $\chi_2$ may be 90° when the head engaging member is in the neutral position, described above; accordingly, the third and fourth planes 145, 146 may be orthogonal to the plane 89 on which the second end 83 of the back 80 is disposed. The head engaging member 100 can be rotated from the neutral position to a first rotated position in which the outer portion 114 of the first side panel 110 is rotated away from the second armrest 74. When in the first rotated position, the sixth angle $\chi_1$ may no longer be 90°. Additionally, the head engaging member 100 can be rotated from the neutral position to a second rotated position in which the outer portion 124 of the second side panel 120 is rotated away from the first armrest 70. When in the second rotated position, the seventh angle $\chi_2$ may no longer be 90°. A skilled artisan will be able to determine how to suitably angle the head engaging member relative to the chair according to a particular example based on various considerations, including the desired procedure of the vestibular optimizer device and the size and shape of the head engaging member. In various example embodiments, either of the outer portions of first and second side panels may have any angle relative to the back when it is in either of the first and second rotated positions. Examples of suitable sixth angles include angles between about 0° and about 50°, angles between about 10° and about 40°, and angles between about 20° and about 30°. Examples of suitable seventh angles include angles between about 0° and about −50°, angles between about −10° and about −40°, and angles between about −20° and about −30°.

Figure 8:
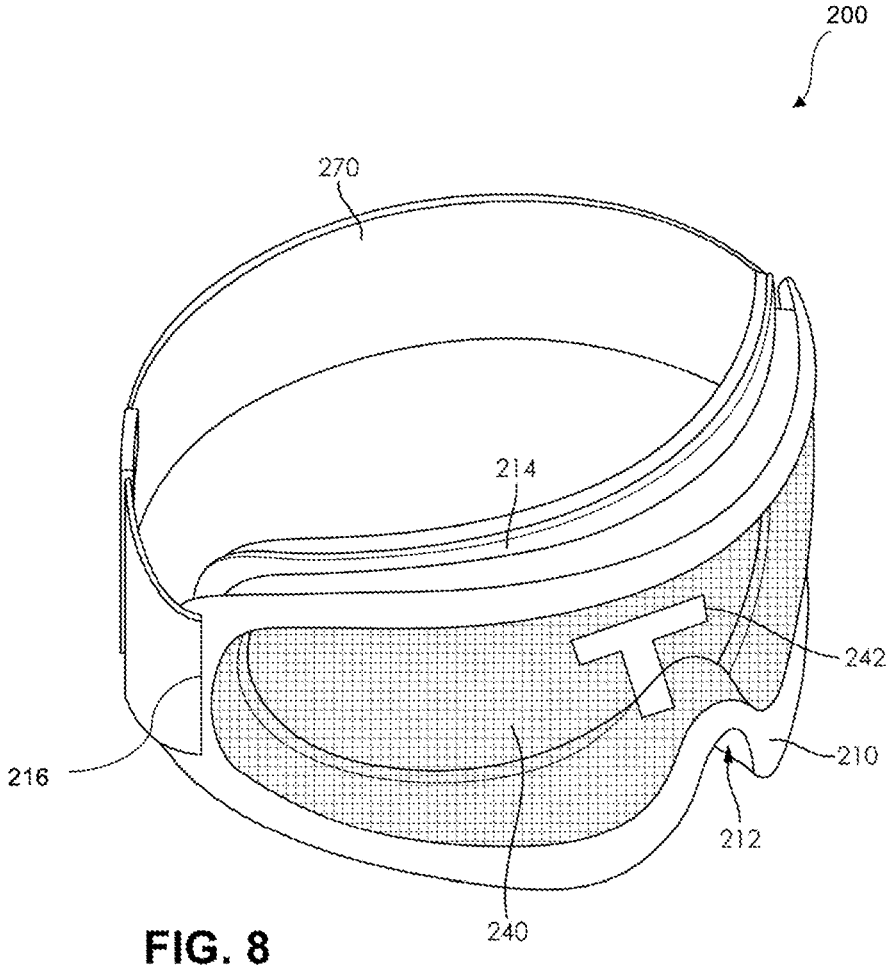
FIG. 8 is a perspective view of a first example goggle apparatus.

FIG. 8 illustrates a goggle apparatus 200 configured to be worn on the head of a subject. The goggle apparatus 200 comprises a frame 210, a lens 240, and a strap 270.

The frame 210 is elongate, curved, and designed to cover both eyes of a subject. The frame 210 includes a cutout 212 designed to abut the nose of a subject. The frame 210 is configured to engage the lens 240 and hold the lens 210 within a channel (not illustrated in the Figures) that extends around the interior portion (not illustrated in the Figures) of the frame 210. The frame 210 also includes a first slot 216 configured to engage the strap 270 and a second slot (not illustrated in the Figures) configured to engage the strap 270. The strap 270 is inserted through the first 216 and second slots and is configured to be worn around a subject's head. The strap 270 is adjustable and can be tightened or loosened based on an individual subject's head size and shape. Optionally, the frame 210 may further include a cushioned portion 214 configured to contact the head of a person. The cushioned portion 214 provides comfort to a wearer of the goggle apparatus 200. The frame may have any size, shape, and configuration, however. A skilled artisan will be able to determine a suitable size, shape, and configuration for the goggle apparatus according to a particular example based on various considerations, including the size, shape, and configuration of the head engaging member. In other example embodiments, the frame may be integrally formed with the lens. In other example embodiments, the frame may not include a cushioned portion and/or a strap.

The lens 240 is substantially opaque and is attached to the frame 210. The opacity of the lens 240 is illustrated by the pattern shown on the lens 240 in FIG. 8. More specifically, the lens 240 is configured to be attached to the frame 210 within its channel. The lens 240 may be comprised of any material, including plastic or a metal, and includes a stimulus 242 on which the subject will concentrate when the goggle apparatus 200 is in use, described below. Thus, when a subject is using the goggle apparatus 200, he or she will, primarily, be able to see the stimulus 242. Therefore, the non-stimulus portions of the lens 240 may be substantially opaque. Though the stimulus 242 is T-shaped in this embodiment, he stimulus may comprise any number, letter, symbol, figure, drawing, combination thereof, and/or other design. A skilled artisan will be able to determine a suitable size, shape, and configuration for the lens and the stimulus according to a particular example based on various considerations including the procedure with which the goggle apparatus will be used. In other example embodiments, the lens may be partially opaque, partially transparent, completely transparent, and/or completely opaque. In other example embodiments, the lens may include zero, one, two, three, or more than three stimuli and the one or more stimuli may have any shape, size, and configuration.

The goggle apparatus 200 is used in conjunction with the vestibular optimizer device 2 to form a vestibular optimizer system (not illustrated in the Figures). The vestibular optimizer system comprises both the vestibular optimizer device 2 and the goggle apparatus 200 and functions to treat vestibular imbalances, afflictions, and/or diseases. The goggle apparatus 200 is worn by a subject and forces the subject to concentrate on a particular stimulus, such as stimulus 242, while the chair 9 and head engaging member 100 of the vestibular optimizer device 2 manipulate the subject's head and body. Using a goggle apparatus 200 with an opaque lens 240 is advantageous because it focuses a subject's vision on the stimulus while their head and/or body is rotated, adjusted, and/or moved relative to the base 10 of the chair 9. Sole focus on the stimulus 242 improves the functioning of the vestibular optimizer device 2 by orienting the head in a particular configuration, which has been proven to reduce vestibular system performance. Accordingly, the goggle apparatus 200 is specifically configured for use with the vestibular optimizer device 2.

Figure 9:
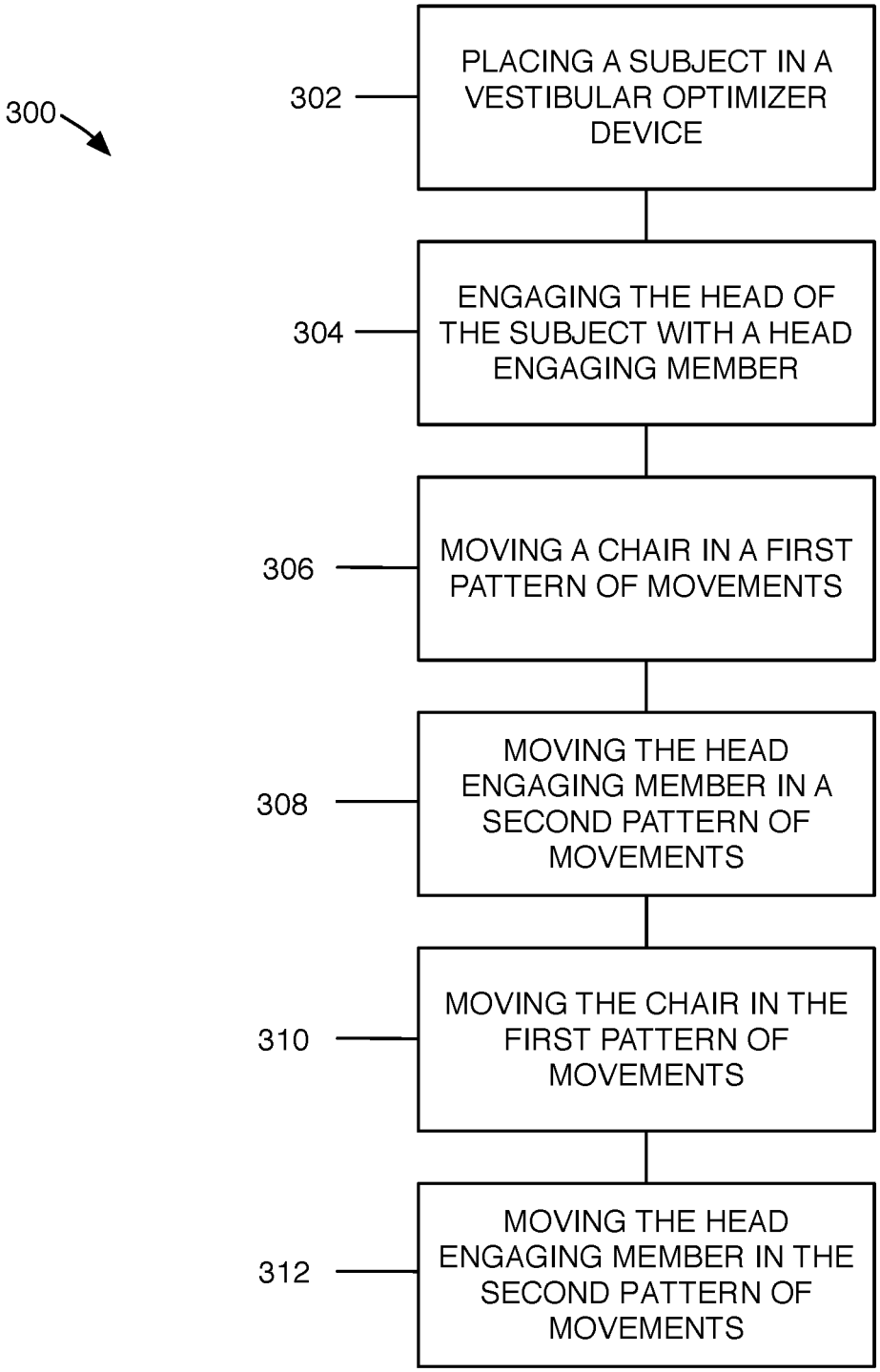
FIG. 9 is a flowchart representation of an example method of administering vestibular stimulation to a subject having a head.

FIG. 9 is a flowchart representation of an example method 300 for administering vestibular stimulation to a subject having a head. Performance of this method 300 results in stimulation of the vestibular system of a subject.

An initial step 302 comprises placing the subject in a vestibular optimizer device, such as the vestibular optimizer device 2 described above. Accordingly, the vestibular optimizer device comprises a chair 9 and a head engaging member 100. The chair 9 may move rotationally, described above, in which the support member 30, and thus the seat 50, rotate about the central longitudinal axis 31 of the support member 30. The chair 9 also may be displaced relative to the base 10, in which the seat 50 of the chair 9 moves toward or away from the base 10, as described above.

Additionally, as described above, the head engaging member 100 includes a neutral position and may be capable of being transitioned into one or more of an extended position, a flexed position, a first rotated position, and a second rotated position. Any suitable vestibular optimizer device may be used to perform this step, however. A skilled artisan will be able to determine a suitable vestibular optimizer device for use for this step according to a particular example based on various considerations, including the particular vestibular deficiency the performer of this step wishes to treat and the size and shape of the subject. In other example embodiments, the chair may move rotationally, but not be displaced relative to the base; it may also be displaced relative to the base, but not move rotationally in other example embodiments. In other example embodiments, the head engaging member may include neutral, extended, and flexed positions, but not include first and second rotated positions. Additionally, in other example embodiments the head engaging member may include neutral, first, and second rotated positions, but not flexed and/or extended positions.

Another step 304 comprises engaging the head of the subject with the head engaging member 100. In this embodiment, the head of the subject is in contact with one or more of the first side panel 110, the second side panel 120, and the base 130 of the head engaging member 100. The head of the subject may also be secured by the adjustable headband 150 of the head engaging member 100. Securing the head of the subject with the adjustable headband 150 is optional, however.

Another step 306 comprises moving the chair 9 in a first pattern of movements. Example first patterns of movements are described below.

Another step 308 comprises moving the head engaging member 100 in a second pattern of movements. Example second patterns of movements are described below.

Optionally, another step 310 may be performed. Step 310 comprises repeating the movement of the chair 9 in a first pattern of movements that is described in step 306.

Optionally, another step 312 may be performed. Step 312 comprises repeating the movement of the chair 9 in a second pattern of movements that is described in step 308.

Any of steps 306, 308, 310, and 312 may be performed in any order. Additionally, various methods exist in which fewer than each of steps are performed. A skilled artisan will be able to determine which of these steps may be performed and their sequence according to a particular example based on various considerations, including the particular vestibular deficiency the performer of this step wishes to treat and the size and shape of the subject. In other example embodiments, only steps 306 and 308 are performed. In other example embodiments, only steps 308 and 310 are performed. In other example embodiments, the subject of the method may wear a goggle apparatus, such as goggle apparatus 200. In other example embodiments, one or more of steps 306, 308, 310, and 312 may be performed between about 1 time and about 20 times, between about 3 and about 12 times, and about 5 and about 8 times.

It is noted that it is considered advantageous to complete the method 300 in the order illustrated and described. However, any order is considered suitable.

EXAMPLES

Below are examples of first patterns of chair movements and second patterns of head engaging member movements. Performance of a first pattern of movements and a second pattern of movements comprise a sequence.

Example 1—First Sequence

The first sequence begins with placing the head engaging member in the extended position. In this example sequence, the fourth angle 132, which is described above, is approximately 40°. Next, the seat of the chair is raised relative to and away from the base. In this example sequence, the chair is raised approximately 36 inches away from the base. Once the chair has been moved, the head engaging member is transitioned from the extended position to the neutral position; accordingly, the third angle $\beta_1$, which is described above, is approximately 90° when in the neutral position. Next, the seat of the chair is lowered relative to and toward the base. In this example sequence, the chair is lowered approximately 36 inches toward the base. The first sequence is then repeated five times.

It is noted that the head engaging member may be placed in the flexed position, in addition to or instead of in the extended position, in other examples.

Example 2—Second Sequence

The second sequence begins with placing the head engaging member in the extended position. In this example sequence, the fourth angle $\beta_2$, which is described above, is approximately 40°. Additionally, when this sequence is performed with a subject, the subject may be wearing a goggle apparatus, such as goggle apparatus 200 described above, and may be told to focus on a stimulus, such as stimulus 242. Next, the seat of the chair is raised relative to and away from the base. In this example sequence, the chair is raised approximately 36 inches away from the base. While the seat is moving away from the base, the head engaging member is transitioned from the extended position to the neutral position; accordingly, the third angle $\beta_1$, which is described above, is approximately 90° when in the neutral position. The head engaging member begins transitioning to the neutral position once the chair is approximately 18 inches away from the base and is fully placed in the neutral position once the hair is approximately 36 inches from the base. The head engaging member is then placed in the extended position and, in this example sequence, the fourth angle $\beta_2$ is approximately 40°. Next, the seat of the chair is lowered relative to and toward the base. In this example sequence, the chair is lowered approximately 36 inches toward the base. The head engaging member is then placed in the neutral position. The second sequence is then repeated five times.

It is noted that the head engaging member may be placed in the flexed position, in addition to or instead of in the extended position, in other examples.

Example 3—Third Sequence

The third sequence begins with placing the head engaging member in the extended position. In this example sequence, the fourth angle $\beta_2$, which is described above, is approximately 40°. Additionally, when this sequence is performed with a subject, the subject may be wearing a goggle apparatus, such as goggle apparatus 200 described above, and may be told to focus on a stimulus, such as stimulus 242. Next, the seat of the chair is raised relative to and away from the base. In this example sequence, the chair is raised approximately 36 inches away from the base. While the seat is moving away from the base, the head engaging member is transitioned from the extended position to the neutral position; accordingly, the third angle $\beta_1$, which is described above, is approximately 90° when in the neutral position. The head engaging member begins transitioning to the neutral position once the chair is approximately 6 inches away from the base and is fully placed in the neutral position once the seat is approximately 36 inches from the base. The head engaging member is then placed in the extended position and, in this example sequence, the fourth angle $\beta_2$ is approximately 40°. Next, the seat of the chair is lowered relative to and toward the base. In this example sequence, the chair is lowered approximately 36 inches toward the base. The head engaging member then begins transitioning to the neutral position once the chair has moved approximately 6 inches toward the base and is fully placed in the neutral position once the seat has been lowered 36 inches toward the base. The third sequence is then repeated five times.

It is noted that the head engaging member may be placed in the flexed position, in addition to or instead of in the extended position, in other examples.

Example 4—Fourth Sequence

The fourth sequence begins with placing the head engaging member in the neutral position. When this sequence is performed with a subject, the subject may be wearing a goggle apparatus, such as goggle apparatus 200 described above, and may be told to focus on a stimulus, such as stimulus 242. Next, the support member and, therefore, the seat of the chair is rotated to a first angle $\alpha_1$ relative to the proximal end of the base, as described above. In this example, the first angle $\alpha_1$ is approximately 50°. Once the chair has been rotated, the head engaging member is transitioned from the neutral position to the first rotated position. In this example, the sixth angle $\chi_1$, described above, is approximately 50° relative to the plane 89 on which the second end 83 of the back 80 is disposed. The chair is then rotated to its original position. The head engaging member is then placed in the neutral position. The fourth sequence is then repeated five times.

It is noted that the fourth sequence also may be performed such that the seat of the chair is rotated to a second angle $\alpha_2$ relative to the proximal end 12 of the base 10. In such an example, the second angle $\alpha_2$ is approximately −50°. Additionally, the head engaging member may be rotated to the second rotated position and to a seventh angle $\chi_2$, described above, that is approximately −50° relative to the plane 89 on which the second end 83 of the back 80 is disposed. The head engaging member may also be placed in the flexed and/or extended positions during this sequence.

Example 5—Fifth Sequence

The fifth sequence begins with placing the head engaging member in the neutral position. When this sequence is performed with a subject, the subject may be wearing a goggle apparatus, such as goggle apparatus 200 described above, and may be told to focus on a stimulus, such as stimulus 242. Next, the support member and, therefore, the seat of the chair is rotated to a first angle $\alpha_1$ relative to the proximal end of the base, as described above. In the Fourth Sequence, described above, the first angle $\alpha_1$ is approximately 50°; in this example, the first angle $\alpha_1$ is approximately 20°. Once the chair has been rotated approximately 15°, the head engaging member is transitioned from the neutral position to the first rotated position. In this example, the sixth angle $\chi_1$, described above, is approximately 50° relative to the plane 89 on which the second end 83 of the back 80 is disposed. The chair is then rotated to its original position. The head engaging member is then placed in the neutral position. The fifth sequence is then repeated five times.

It is noted that the fifth sequence also may be performed such that the seat of the chair is rotated to a second angle $\alpha_2$ relative to the proximal end 12 of the base 10. In such an example, the second angle $\alpha_2$ is approximately −20°. Additionally, the head engaging member may be rotated to the second rotated position and to a seventh angle $\chi_2$, described above, that is approximately −50° relative to the plane 89 on which the second end 83 of the back 80 is disposed. The head engaging member may also be placed in the flexed and/or extended positions during this sequence.

Example 6—Sixth Sequence

The sixth sequence begins with placing the head engaging member in the neutral position. When this sequence is performed with a subject, the subject may be wearing a goggle apparatus, such as goggle apparatus 200 described above, and may be told to focus on a stimulus, such as stimulus 242. Next, the support member and, therefore, the seat of the chair is rotated to a first angle $\alpha_1$ relative to the proximal end of the base, as described above. In the Fourth Sequence, described above, the first angle $\alpha_1$ is approximately 50°; in this example, the first angle $\alpha_1$ is approximately 10°. Once the chair has been rotated approximately 5°, the head engaging member is transitioned from the neutral position to the first rotated position. In this example, the sixth angle $\chi_1$, described above, is approximately 50° relative to the plane 89 on which the second end 83 of the back 80 is disposed. The chair is then rotated to its original position. The head engaging member is then placed in the neutral position. The sixth sequence is then repeated five times.

It is noted that the sixth sequence also may be performed such that the seat of the chair is rotated to a second angle $\alpha_2$ relative to the proximal end 12 of the base 10. In such an example, the second angle $\alpha_2$ is approximately −10°. Additionally, the head engaging member may be rotated to the second rotated position and to a seventh angle $\chi_2$, described above, that is approximately −50° relative to the plane 89 on which the second end 83 of the back 80 is disposed. The head engaging member may also be placed in the flexed and/or extended positions during this sequence.

All components of the vestibular optimizer devices and systems can be made from any suitable material. Non-limiting examples of suitable materials include one or more metals, one or more plastics, and some combination of metal and plastic.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

I claim:

1. A vestibular optimizer device configured to administer vestibular stimulation to a subject having a head, comprising:

a chair having a base, a seat, a back, and a support member, the support member extending from the base to the seat, comprising a central longitudinal axis, and being attached to the seat, the support member rotatable about the central longitudinal axis, the seat adapted to move toward and away from the base, the chair adapted to move in a first pattern of movements;

a head engaging member attached to the back of the chair and configured to engage said head of said subject, the head engaging member having a main body comprising a first side panel, a second side panel, a base disposed between the first side panel and the second side panel, and an adjustable headband attached to the base, at least one other axis parallel to the central longitudinal axis independent of movement of the chair about the central longitudinal axis and adapted to move in a second pattern of movements;

a motor;

a first control unit operably connected to the motor, the first control unit configured to control movement of the support member of the chair; and a second control unit operably connected to the motor, the second control unit configured to control movement of the head engaging member.

2. The vestibular optimizer device of claim 1, wherein the chair and the head engaging member can move contemporaneously.

3. The vestibular optimizer device of claim 1, wherein the motor is disposed within the base of the chair.

4. The vestibular optimizer device of claim 1, further comprising a first armrest attached to the seat of the chair.

5. The vestibular optimizer device of claim 4, further comprising a second armrest attached to the seat of the chair.

6. The vestibular optimizer device of claim 5, further comprising a leg rest attached to the seat of the chair.

7. The vestibular optimizer device of claim 1, wherein the support member comprises a shaft.

8. A system configured to administer vestibular stimulation to a subject having a head, comprising:

a chair having a base, a seat, a back, and a support member, the support member extending from the base to the seat, comprising a central longitudinal axis, and being attached to the seat, the support member rotatable about the central longitudinal axis, the seat adapted to move toward and away from the base, the chair adapted to move in a first pattern of movements;

a head engaging member attached to the back of the chair and configured to engage the head of said subject, the head engaging member having a main body comprising a first side panel, a second side panel, a base disposed between the first side panel and the second side panel, and an adjustable headband attached to the base, at least on other axis parallel to the central longitudinal axis independent of movement of the chair about the central longitudinal axis and adapted to move in a second pattern of movements;

a motor;

a first control unit operably connected to the motor, the first control unit configured to control movement of the support member of the chair;

a second control unit operably connected to the motor, the second control unit configured to control movement of the head engaging member; and a goggle apparatus configured to be worn on said head of said subject, the goggle apparatus comprising a frame, a lens attached to the frame, and a strap attached to the frame and configured to engage said head.

9. The system of claim 8, wherein the lens is able to display at least one stimulus.

10. The system of claim 9, wherein the lens is at least partially opaque.

11. A method of administering vestibular stimulation to a subject having a head, comprising the steps of:

placing the subject in a vestibular optimizer device comprising a chair having a base, a seat, a back, and a support member, the support member extending from the base to the seat, comprising a central longitudinal axis, and being attached to the seat, the support member rotatable about the central longitudinal axis, the seat adapted to move toward and away from the base, the chair adapted to move in a first pattern of movements, a head engaging member attached to the back of the chair and configured to engage the head of said subject, the head engaging member having a main body comprising a first side panel, a second side panel, a base disposed between the first side panel and the second side panel, and an adjustable headband attached to the base, at least one other axis parallel to the central longitudinal axis independent of movement of the chair about the central longitudinal axis and adapted to move in a second pattern of movements, a motor, a first control unit operably connected to the motor, the first control unit configured to control movement of the support member of the chair, and a second control unit operably connected to the motor, the second control unit configured to control movement of the head engaging member; and engaging said head of the subject with the head engaging member;

moving the chair in the first pattern of movements; and moving the head engaging member in the second pattern of movements.

12. The method of claim 11, wherein the moving the chair in the first pattern of movements step is performed before the moving the head engaging member in the second pattern of movements step.

13. The method of claim 11, wherein the moving the chair in the first pattern of movements step is performed at the same time as the moving the head engaging member in the second pattern of movements step.

14. The method of claim 11, wherein the step of moving the chair in the first pattern of movements is repeated.

15. The method of claim 11, wherein the step of moving the head engaging member in the second pattern of movements is repeated.

* * * * *